US007740149B2

(12) United States Patent
Luburic

(10) Patent No.: US 7,740,149 B2
(45) Date of Patent: Jun. 22, 2010

(54) CONTAINER SIDEWALL STRENGTHENING APPARATUS AND METHODS

(75) Inventor: Frano Luburic, Anaheim Hills, CA (US)

(73) Assignee: Ropak Corporation, Fountain Valley, CA (US)

( * ) Notice: Subject to any disclaimer, the term of this patent is extended or adjusted under 35 U.S.C. 154(b) by 0 days.

(21) Appl. No.: 10/256,925

(22) Filed: Sep. 27, 2002

(65) Prior Publication Data

US 2004/0060942 A1 Apr. 1, 2004

(51) Int. Cl.
*B65D 6/04* (2006.01)
*B65D 6/38* (2006.01)
*B65D 8/12* (2006.01)
*B65D 90/02* (2006.01)

(52) U.S. Cl. ..... 220/671; 220/675

(58) Field of Classification Search ..... 206/503, 206/508; 220/4.27, 669, 673, 770, 771, 675, 220/670, 671
See application file for complete search history.

(56) References Cited

U.S. PATENT DOCUMENTS

| | | | | | |
|---|---|---|---|---|---|
| 236,518 | A | * | 1/1881 | Vivarttas | 229/67 |
| 1,249,606 | A | | 12/1917 | Eaton | |
| 1,266,574 | A | | 5/1918 | Ford | |
| 1,833,456 | A | | 11/1931 | DeGant | |
| 2,935,108 | A | * | 5/1960 | Hall | 220/780 |
| 3,120,322 | A | * | 2/1964 | Henninger | 220/675 |
| 3,186,586 | A | * | 6/1965 | Box | 206/511 |
| 3,247,673 | A | | 4/1966 | Schneller | |
| 3,303,965 | A | * | 2/1967 | Parker et al. | 206/511 |
| 3,335,902 | A | | 8/1967 | Javorik | |
| 3,419,184 | A | * | 12/1968 | Asenbauer | 206/508 |
| 3,438,544 | A | * | 4/1969 | Cloyd | 206/596 |
| 3,680,735 | A | * | 8/1972 | Lucas | 206/511 |
| 3,694,995 | A | | 10/1972 | McKinney | |
| 3,759,006 | A | | 9/1973 | Tamboise | |
| 3,987,829 | A | * | 10/1976 | Leone | 220/796 |
| 3,998,327 | A | * | 12/1976 | Box | 206/508 |
| 4,030,246 | A | | 6/1977 | Naylor | |
| 4,113,095 | A | * | 9/1978 | Dietz et al. | 206/508 |
| 4,232,612 | A | | 11/1980 | Winsor | |
| 4,235,346 | A | | 11/1980 | Liggett | |
| 4,257,527 | A | * | 3/1981 | Snyder et al. | 220/675 |
| 4,432,467 | A | * | 2/1984 | Swingley, Jr. | 220/826 |

(Continued)

FOREIGN PATENT DOCUMENTS

DE 42 28 204 A1 3/1994

(Continued)

OTHER PUBLICATIONS

Machine Translation of DE 42 28 204 A1.*

(Continued)

*Primary Examiner*—Harry A Grosso
(74) *Attorney, Agent, or Firm*—McKenna Long & Aldridge LLP

(57) ABSTRACT

Apparatus and methods relate to containers having a sidewall portion with at least one generally vertical corrugation therein. The containers can be of a variety of shapes, sizes, cross-sections, and materials. The corrugation improves the container sidewall strength and resistance to buckling under compressive loads such as stacking of multiple containers.

31 Claims, 6 Drawing Sheets

U.S. PATENT DOCUMENTS

| | | | | | |
|---|---|---|---|---|---|
| 4,523,692 | A | * | 6/1985 | Lemkin | 220/788 |
| 4,591,065 | A | | 5/1986 | Foy | |
| 4,775,068 | A | | 10/1988 | Reiland et al. | |
| 4,805,793 | A | | 2/1989 | Brandt et al. | |
| 4,917,255 | A | | 4/1990 | Foy et al. | |
| 4,967,927 | A | | 11/1990 | Reiland et al. | |
| 5,002,199 | A | | 3/1991 | Frahm | |
| 5,010,013 | A | | 4/1991 | Serkes et al. | |
| 5,046,659 | A | | 9/1991 | Warburton | |
| 5,094,356 | A | | 3/1992 | Miller | |
| 5,141,121 | A | | 8/1992 | Brown et al. | |
| 5,178,290 | A | | 1/1993 | Ota et al. | |
| 5,199,592 | A | | 4/1993 | Reiland et al. | |
| 5,238,129 | A | | 8/1993 | Ota | |
| 5,303,834 | A | | 4/1994 | Krishnakumar et al. | |
| 5,383,314 | A | | 1/1995 | Rothberg | |
| 5,398,835 | A | | 3/1995 | Blinstrub | |
| 5,423,453 | A | * | 6/1995 | Fritz | 220/608 |
| 5,456,379 | A | * | 10/1995 | Krupa et al. | 220/835 |
| 5,457,921 | A | | 10/1995 | Kostrzecha | |
| 5,458,255 | A | | 10/1995 | Addeo et al. | |
| 5,474,197 | A | | 12/1995 | Hillis et al. | |
| 5,573,117 | A | | 11/1996 | Adams | |
| 5,586,675 | A | | 12/1996 | Borsboom et al. | |
| D382,401 | S | | 8/1997 | Provot | |
| 5,829,595 | A | | 11/1998 | Brown et al. | |
| 5,860,527 | A | * | 1/1999 | Frankenberg et al. | 206/509 |
| 5,899,355 | A | | 5/1999 | Claydon et al. | |
| 5,921,429 | A | | 7/1999 | Gruenbacher et al. | |
| 5,938,059 | A | | 8/1999 | Luburic | |
| 5,975,413 | A | | 11/1999 | Moen | |
| 6,170,689 | B1 | | 1/2001 | Flesher et al. | |
| 6,283,319 | B1 | | 9/2001 | Hillis et al. | |
| 6,305,566 | B1 | | 10/2001 | Pigott et al. | |
| 6,308,858 | B1 | * | 10/2001 | Koefelda | 220/608 |
| 6,318,586 | B1 | * | 11/2001 | Frankenberg | 220/826 |
| 6,324,812 | B1 | | 12/2001 | Drya-Lisiecka | |
| 6,349,427 | B1 | | 2/2002 | Bergstrom | |
| 6,394,301 | B1 | | 5/2002 | Koch | |
| 6,431,394 | B2 | * | 8/2002 | Frankenberg | 220/826 |
| 6,467,639 | B2 | | 10/2002 | Mooney | |
| 6,918,502 | B1 | | 7/2005 | Overholt et al. | |
| 7,111,562 | B2 | | 9/2006 | Nolan | |
| 7,331,480 | B1 | | 2/2008 | Nolan | |
| 2003/0146212 | A1 | | 8/2003 | Mai et al. | |

FOREIGN PATENT DOCUMENTS

| | | |
|---|---|---|
| EP | 0485672 A1 | 5/1992 |

OTHER PUBLICATIONS

Photographs of a container representative of a container sold as early as Jul. 2001.

* cited by examiner

CONTAINER SIDEWALL STRENGTHENING APPARATUS AND METHODS

This invention relates generally to containers, and more specifically to new methods and apparatus for strengthening containers by forming at least one cross-sectional shape or pattern into the container sidewall.

BACKGROUND OF THE INVENTION

Containers (such as plastic injection-molded buckets or pails or the like) come in a wide variety of shapes and sizes. Commonly, these have generally flat and/or smooth curved sidewalls. Sometimes reinforcing ribs or other features are formed or provided on the exterior and/or interior of the container. In many applications, the containers are designed to be nestable and stackable. When the containers are filled, the stacking loads can be substantial, and the sidewalls typically have to be designed and tested to support and withstand certain threshold requirements (to avoid failure when they are dropped or stacked, etc.).

When sufficient force is exerted downwardly on such containers, the container can collapse or "fail." Commonly, this failure begins with or includes the weakest point of the container sidewall buckling in or out (toward or away from the inside of the container). Among other situations, such loading and buckling failures can occur when filled containers are stacked too high on each other. Even for unstacked single containers, however, sufficient force can cause such a failure.

It is desirable to provide a container with improved strength and durability to withstand heavy loads (such as imposed by stacking filled containers, or any other kind of force applied downwardly), without bending or crumpling.

OBJECTS AND ADVANTAGES OF THE INVENTION

It is, therefore, an object of the invention to provide a container or bucket having a bottom and a sidewall portion extending upwardly therefrom, the sidewall portion including at least one generally vertical corrugation formed therein. In many applications, a plurality of such corrugations will be useful. Among other things, the corrugation strengthens the sidewall and improves its resistance to buckling and other forces, such as may occur when the container is loaded with product or is in a stack of heavy objects (such as similar containers).

Depending on the application, the corrugation can extend across all or some of the height of the sidewall portion. The container or bucket can have any suitable cross-section, including generally circular, generally rectangular, square, etc. The corrugation can be located on the sidewall at a variety of locations (such as near a corner, for containers having corners in cross-section), and can be spaced regularly or randomly. The specific cross-section or cross-sections of the corrugation or corrugations can be a wide variety, depending on the materials from which the container is fabricated and the application for which it is to be used.

Another object of the invention is to provide a container and lid combination of the aforementioned character, and a plurality of such containers in a stacked arrangement.

It is a further object of the invention to provide a container of the aforementioned character with at least one generally horizontal reinforcing rib extending substantially about the sidewall portion of the container, with the rib spanning across the corrugation. The horizontal reinforcing rib can be on the exterior or interior, or both, of the sidewall portion.

Yet another object of the invention is to provide a bucket of the aforementioned character, in which the bucket is fabricated from injection molded plastic.

Still another object of the invention is to provide methods related to containers or buckets of the aforementioned character, including methods for fabricating same, and methods of using same to store things.

A still further object of the invention is to reduce the amount of material required to form a wall having a given strength, so that lighter-weight walls are able to carry greater loads, with less material being required to provide a container of a given "strength", etc. Among other things, the invention may be used on containers for transporting materials and things. In such applications, the container itself is simply added weight that must be transported (the thing inside the container typically being the item sought by the end user). Accordingly, by providing sufficient container wall strength with less material, the costs of shipping are reduced because each "thing" in its package weighs less. Thus, persons of ordinary skill in the art will understand that the invention is economically and environmentally beneficial.

Other objects and advantages of the invention will be apparent from the following specification and the accompanying drawings, which are for the purpose of illustration only. It is understood that changes in the specific structure shown and described may be made within the scope of the claims without departing from the spirit and scope of the invention.

DESCRIPTION OF PREFERRED EMBODIMENTS

The detailed description herein and in the appended drawings is intended as a description of the presently preferred embodiments of the invention, but is not intended to represent the only forms in which the present invention may be constructed or utilized. The description sets forth a preferred construction and preferred functions of the invention, as well as a preferred sequence of steps for operating the invention in connection with the illustrated embodiments. It is to be understood, however, that the same or equivalent functions and sequences may be accomplished by different embodiments that are also intended to be encompassed within the spirit and scope of the invention and the claims below.

Figure 1:
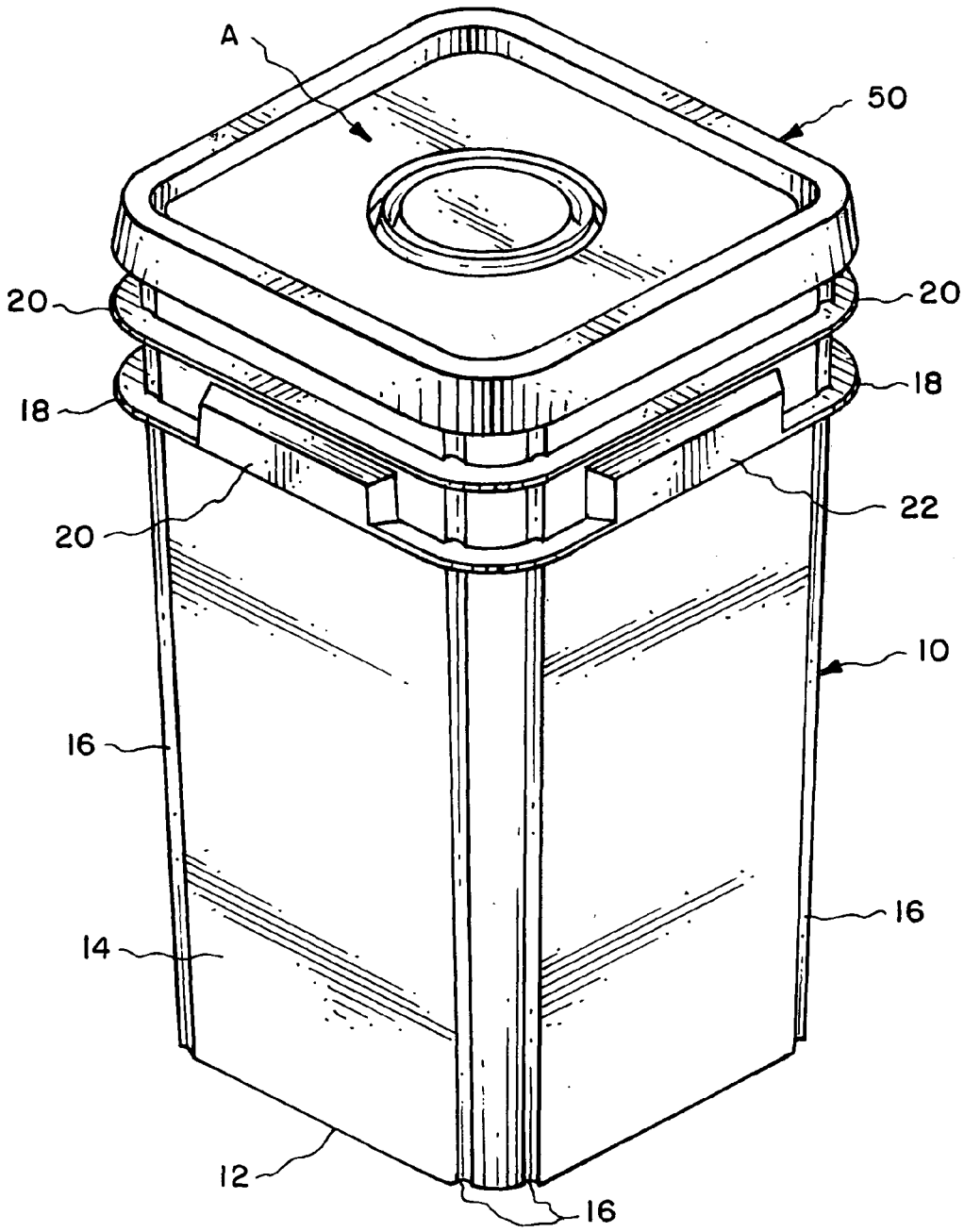
FIG. 1 is a perspective view illustrating a preferred embodiment of a container and lid assembly of the invention, for a container having a generally square cross-section.
Figure 2:
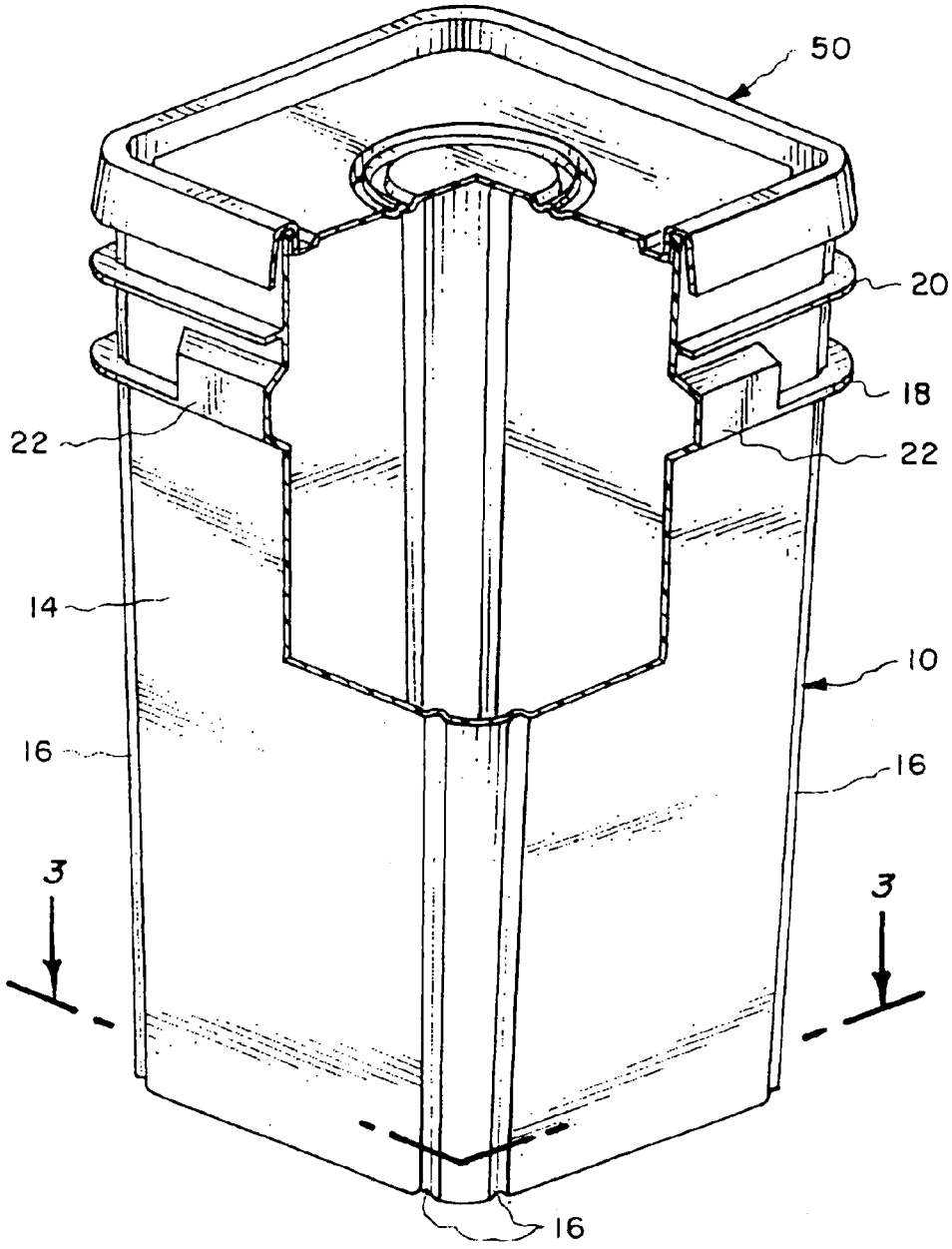
FIG. 2 is similar to FIG. 1, but shows a partial cutaway of the corner section of the preferred assembly.
Figure 3:
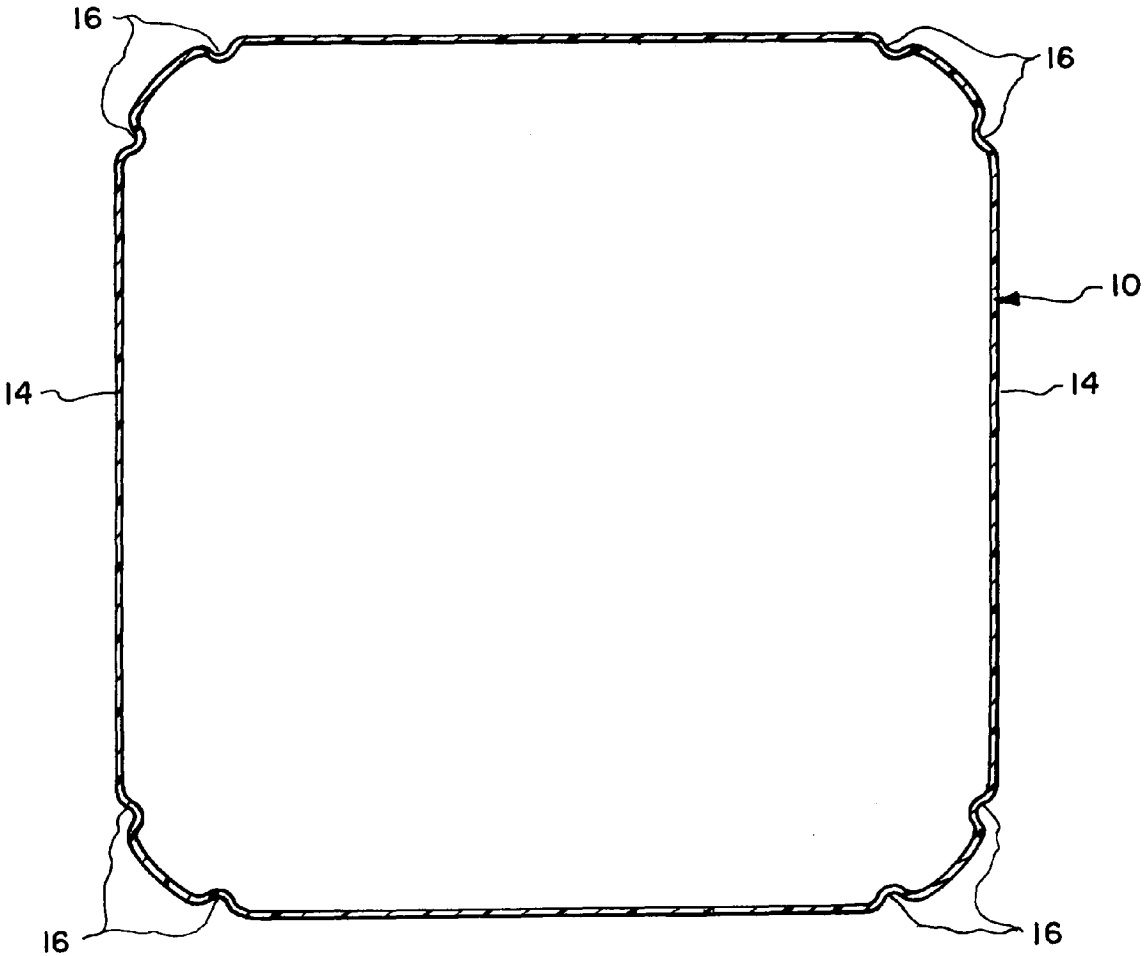
FIG. 3 is a sectional view taken along reference line 3-3 of FIG. 2.

As best illustrated in FIGS. 1-3, and particularly to FIG. 1, the preferred container 10 and a mating lid preferably can be fabricated from any suitably strong, lightweight material (such as plastic, metal, or the like). The container 10 preferably includes a base 12 and a sidewall portion 14 extending upwardly therefrom. A lid 50 preferably is provided to close the top of the container.

Persons of ordinary skill in the art will understand that the general shape and dimensions of the base 12, the sidewall portion 14, and the lid 50 can be configured across a wide useful range, depending on the materials used, the applications for which the container is intended, and other factors. They will likewise understand that the invention can be incorporated into a wide variety of containers having various different methods of engagement between the lid and the container body sidewalls.

One or more corrugations or fluting members 16 (as best shown in FIG. 3) preferably are provided in the sidewall portion 14. Among other things, the corrugations or fluting 16 help strengthen the sidewall portion of the container, and thereby the entire container assembly, against forces in the direction of arrow A in FIG. 1.

The corrugations or fluting members 16 can be shaped and located and sized in a wide variety of ways, and still provide some of the benefits of the invention. They are illustrated in FIGS. 1-3 as a pair of indentations at each corner of a generally square or rectangular container, and as extending substantially the full height of the sidewall 14. Persons of ordinary skill in the art will understand that many factors can be customized to provide a desired balance of strength, weight, and performance for a desired application. These include, by way of example and not by way of limitation, the depth of the indentations, the thickness of the sidewall 14 at those locations, the sharpness of the indentations' angles with respect to the adjacent sidewall areas, the indentations' angularity or smoothness in cross-section, the frequency and regularity of the pattern of the indentations, the spacing between the indentations, and other factors.

Figure 4:
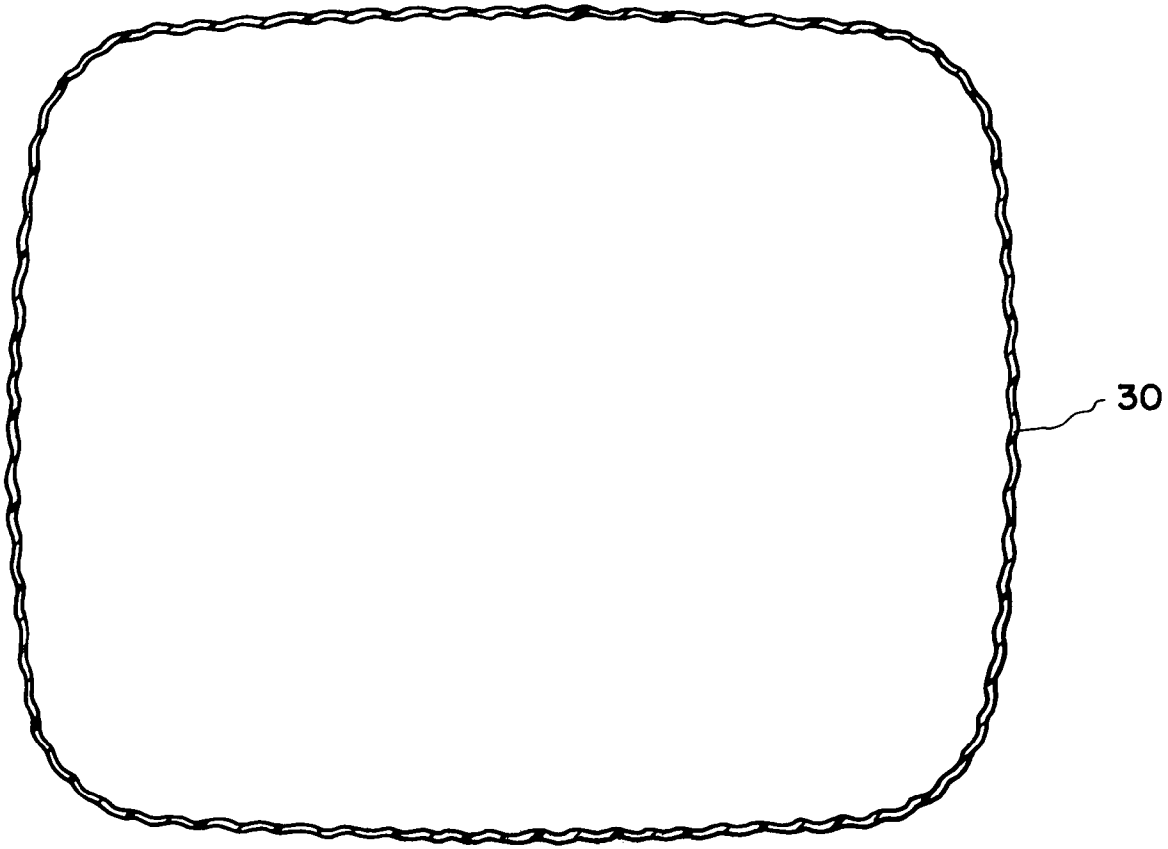
FIG. 4 is similar to FIG. 3, but illustrates one of the many alternative embodiments of the present invention, namely, a container with a generally rectangular-shaped cross-section having sidewalls with a fluted or corrugated configuration.
Figure 5:
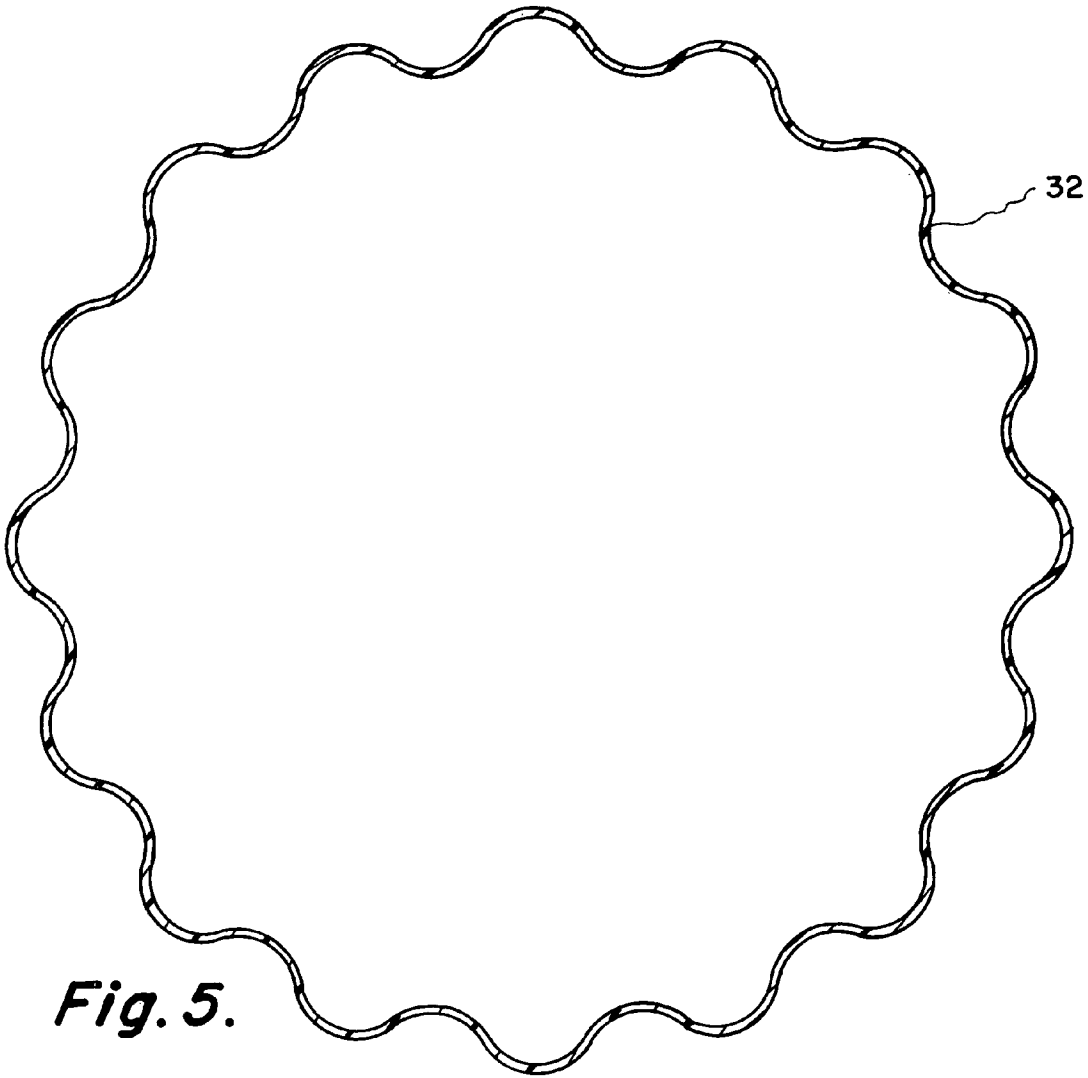
FIG. 5 is similar to FIGS. 3 and 4, but illustrates yet another of the many alternative embodiment of the present invention, namely, a container with a generally circular-shaped cross-section having sidewalls with a fluted or corrugated configuration.
Figure 6:
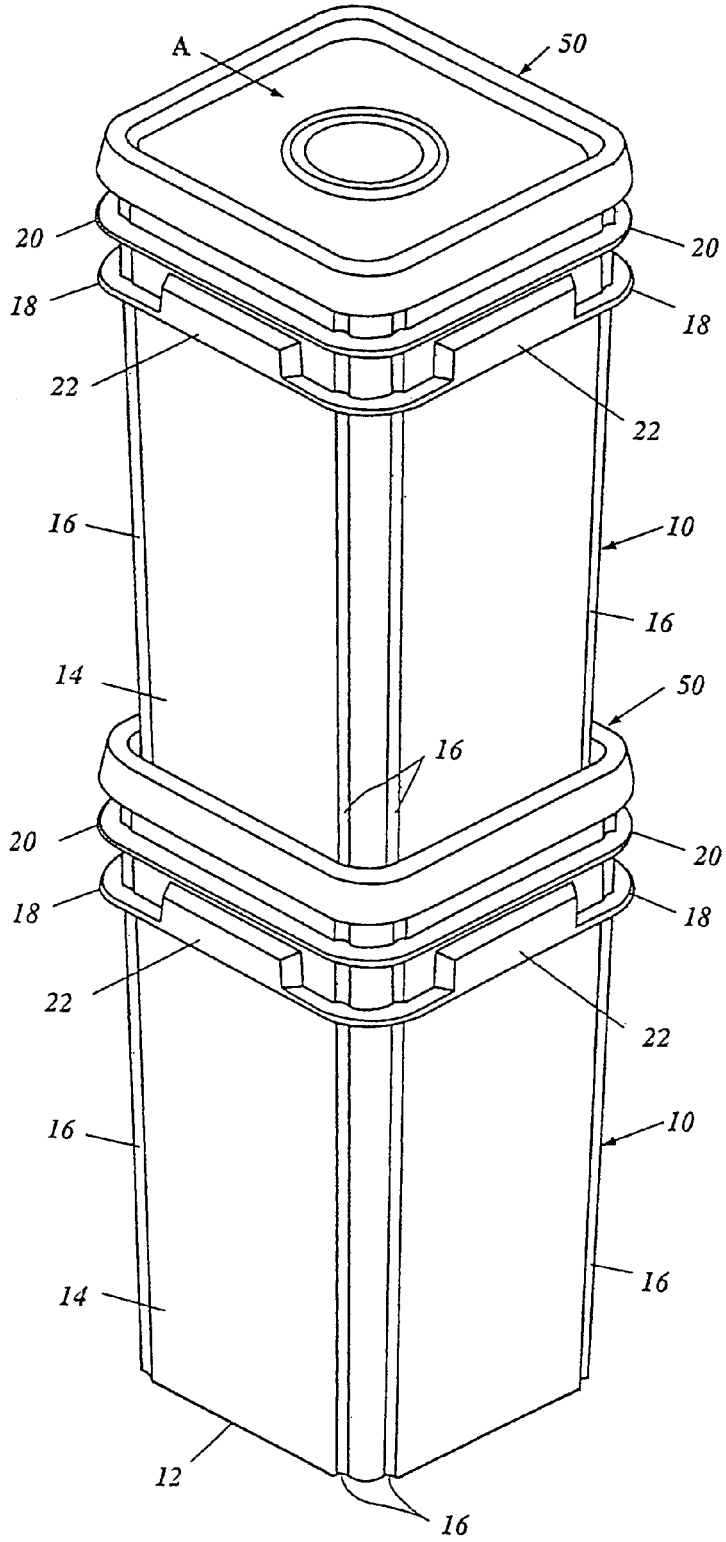
FIG. 6 is similar to FIG. 1 and illustrates a container and lid stacked upon another container and lid.

Examples of some of those many alternative designs are shown in FIG. 4 (illustrating a relatively shallow fluting 30 having a regular pattern around the periphery of a generally rectangular container) and FIG. 5 (showing a generally round container with relatively "deeper" and proportionally larger flute structures 32). FIGS. 4 and 5 illustrate a fairly regularly, sinusoidal or wavy pattern of corrugations, persons of ordinary skill in the art will understand that other embodiments can include spaced irregularities, and other patterns and features within the corrugations or fluted pattern. Among the many other container shapes in which the invention has utility are oval, diamond, and others.

Preferably, the fluting or corrugations 16 and the entire container assembly are strengthened by one or more generally horizontal rib structures 18 and 20. Persons of ordinary skill in the art will understand that these can be similar to conventional reinforcing ribs on container sidewalls, and that they preferably surround the periphery of the container's exterior to provide (among other things) hoop strength against internal loads and forces. Preferably, the ribs 18 and 20 span across the corrugations 16 and are affixed to the sidewall at opposite sides of each corrugation, to provide the desired hoop strength and to prevent undesired deformation of the container in the area of the corrugation. The location, angle, frequency, thickness, and other characteristics of any such reinforcing ribs 18 can be customized depending on a variety of factors.

To provide a sealing engagement with a lid for embodiments in which the corrugations extend completely to the top of the container, the lid would have to have a corresponding pattern in its mating structure. Alternatively, the corrugations can be stopped below the top of the sidewall, permitting the use of conventional lid sealing arrangements, and also providing a step or ledge on which an internal flange on the lid can rest. That point of contact can help transfer loads that may be imposed by stacking or similar situations.

For embodiments fabricated via injection molding of the like, the entire intersection of rib(s), corrugations, and sidewall portion can be integrally formed, providing even further strength. For other manufacturing processes and materials, welding, gluing, or other means may be used effectively to bond these elements to each other. Persons of ordinary skill in the art will understand that not all of those elements have to be bonded to each other to provide some of the desired strengthening.

One or more handles 22 can be formed on the sidewall portion 14, and may be connected to or integrally formed with a horizontal rib such as rib 18.

Persons of ordinary skill in the art also will understand that conventional molding and other fabrication techniques can be utilized to manufacture the container of the invention.

Thus, the preferred embodiment of the present invention provides methods and apparatus for strengthening containers by forming the sidewalls so that the cross-section of the wall includes something other than straight lines or smooth "concave out" arcs or curves. For example, a conventional round container without the invention has a cross section with a continuous "concave out" arc. In that regard, persons of ordinary skill in the art will understand that a wide variety of cross-sectional shapes may be used effectively in the invention (besides straight lines or smooth "concave out" arcs or curves). In other words, the invention includes forming one or more cross-sectional shapes or patterns into a container sidewall.

The pattern or patterns can be relatively consistent (such as the sinusoidal or wavy pattern of FIGS. 4 and 5), can include spaced irregularities, can have relatively sharp (FIGS. 1-3) or smooth patterns or elements, etc. The "depth" of the pattern (how far in or out the element is positioned off of the general trend line of the wall's cross-section) and the particular cross-sectional shape itself can be selected in order to provide varying degrees of "strength" for a given wall thickness. In alternative embodiments of the invention (not shown), the wall thickness itself can be varied at locations around the container and even within a single corrugation, to provide more or less strength and weight, etc.

Preferably, the patterns or elements formed in the sidewalls extend generally the full height of the sidewall, and can "terminate" at the top and bottom in any suitable manner. In alternative embodiments (not shown), however, the patterns or elements can extend for only a part of the height of the wall, can be formed in sections spaced vertically from each other in a single container sidewall, or can be in any of a wide variety of other configurations and combinations.

Methods of the invention include, by way of example and not by way of limitation, forming containers of the type described herein, nesting and stacking same, handling materials using such containers and associated lids, and other methods. Among other things, persons of ordinary skill in the art will understand that the corrugations make it less likely that heavy loads (such as caused by the contents of the containers and/or by the stacking of similar containers, or other things) will buckle the sidewall of the container.

Benefits of the invention include, again by way of example and not by way of limitation, thinner walls being able to carry greater loads, less material being required to provide a container of a given "strength", etc. Among other things, the invention may be used on containers for transporting materials and things. In such applications, the container itself is simply added weight that must be transported (the thing inside the container typically being the item sought by the end user). Accordingly, by providing sufficient container wall strength with less material, the costs of shipping are reduced because each "thing" in its package weighs less. Thus, persons of ordinary skill in the art will understand that the invention is economically and environmentally beneficial.

For square or other containers having corners, the patterns or other elements can be located in the one or more of the corners (FIGS. 1-3 show it in all four corners), on one or more of the sidewalls between the corners, or a combination of the foregoing.

Persons of ordinary skill in the art will understand that the container can be fabricated in any of a wide range of useful sizes as well as a wide variety of shapes, and can be manufactured from a wide variety of materials, including plastic, metal, etc. Methods of manufacture include injection molding, blow-molding, and similar processes. Persons of ordinary skill in the art also will understand that the containers preferably are nestable and stackable with other similarly sized and shaped containers (among other things, this facilitates manufacture, handling, and storage of the containers in an unfilled condition).

The apparatus and methods of my invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

I claim:

1. A nestable plastic container, comprising:

a base;

a sidewall integrally formed with and extending upwardly from the base, the sidewall surrounding an inner cavity and having an upper edge defining an opening into the inner cavity;

a first generally vertical corrugation in a corner of the sidewall and the base, the corrugation being concave as viewed from outside the container;

upper and lower generally horizontal reinforcement ribs integrally formed with and crossing the corner of the sidewall, wherein the upper generally horizontal reinforcement rib is below the upper edge of the sidewall, and wherein the distance between the lower generally horizontal reinforcement rib and the base is greater than the distance between the lower generally horizontal reinforcement rib and the upper edge of the sidewall; and a handle connected to and integrally formed with the lower generally horizontal reinforcement rib, wherein the base, the sidewall, the first generally vertical corrugation, the upper and lower generally horizontal reinforcement ribs and the handle are integrally formed together via injection molding.

2. The plastic container of claim 1, wherein the first generally vertical corrugation protrudes inward a distance greater than a thickness of the sidewall.

3. The plastic container of claim 1, wherein the upper and lower generally horizontal ribs extend from the sidewall a distance greater than a thickness of the sidewall.

4. The plastic container of claim 1, wherein a distance between the upper edge and the lower generally horizontal rib is greater than a distance the first generally vertical corrugation protrudes inward.

5. The plastic container of claim 1, wherein a distance between the upper edge and the lower generally horizontal rib is greater than a width of the first generally vertical corrugation.

6. The plastic container of claim 1, wherein a distance between the upper edge and the lower generally horizontal rib is greater than a distance the upper and lower generally horizontal ribs extend from the sidewall.

7. The plastic container of claim 1, wherein a distance between the upper edge and the upper horizontal rib is greater than a thickness of the sidewall.

8. The plastic container of claim 1, wherein the upper and lower horizontal reinforcement ribs extend from the sidewall a distance less than a distance between the upper and lower horizontal reinforcement ribs.

9. The plastic container of claim 1, wherein the first generally vertical corrugation has a height greater than the distance between the upper and lower horizontal reinforcement ribs.

10. The plastic container of claim 1, wherein the first vertical corrugation has a height greater than the distance between the lower horizontal reinforcement rib and the upper edge of the sidewall.

11. The plastic container of claim 1, wherein a length of the upper horizontal reinforcement rib is greater than the length of the base.

12. The plastic container of claim 1, wherein the corner of the sidewall is symmetric with respect to a vertical plane 45 degrees from both sides adjacent to the corner portion.

13. The plastic container of claim 1, wherein the upper edge of the sidewall has a thickness less than an amount the first generally vertical corrugation protrudes into the sidewall.

14. The plastic container of claim 1, wherein the first generally vertical corrugation protrudes away from both sides adjacent to the corner portion.

15. The plastic container of claim 1, wherein a width of the first generally vertical corrugation at the base is greater than a thickness of the sidewall.

16. The plastic container of claim 1, wherein the container is symmetric about a vertical plane parallel to the length of the base and cutting the container in half.

17. The plastic container of claim 1, wherein the container is symmetric about a vertical plane parallel to the width of the base and cutting the container in half.

18. The plastic container of claim 1, wherein the first generally vertical corrugation stops below the top of the sidewall.

19. The plastic container of claim 1, further comprising a second generally vertical corrugation nearest to the first generally vertical corrugation, the second corrugation being concave as viewed from outside the container.

20. The plastic container of claim 19, wherein a distance between the first and second generally vertical corrugations is greater than a distance the first and second vertical corrugations protrude inward.

21. The plastic container of claim 19, wherein a distance between the first and second generally vertical corrugations is less then a height of the first and second generally vertical corrugations.

22. The plastic container of claim 1, further comprising a second generally vertical corrugation in another corner of the sidewall, the second corrugation being concave as viewed from outside the container.

23. The plastic container of claim 22, wherein no generally vertical corrugations being concave as viewed from outside the container are included between the first and second generally vertical corrugations.

24. The plastic container of claim 22, wherein a height of the container is greater than a distance between the first and second generally vertical corrugations.

25. The plastic container of claim 22, wherein sidewalls have no corrugations except in four corner portions of the container.

26. The plastic container of claim 22, wherein the sidewall extends substantially straight from one corner portion to another corner portion.

27. The plastic container of claim 1, wherein the handle protrudes from an exterior of the sidewall and is between the upper and lower reinforcement ribs.

28. The plastic container of claim 27, wherein a length of the handle is greater then a distance between the upper and lower horizontal reinforcement ribs.

29. The plastic container of claim 27, wherein a length of the handle is greater than a distance between the upper horizontal reinforcement rib and the upper edge of the sidewall.

30. The plastic container of claim 27, wherein a distance between the sidewall and an exterior-facing wall of the handle is less than a distance between the lower horizontal reinforcement rib and the upper edge of the sidewall.

31. A nestable plastic container, comprising:

a base;

a sidewall integrally formed with and extending upwardly from the base, the sidewall surrounding an inner cavity and having an upper edge defining an opening into the inner cavity, wherein a distance between the upper edge of the sidewall and the base is substantially the same around the periphery of the container;

a first generally vertical curved corrugation in a corner of the sidewall and the base, the corrugation being concave as viewed from outside the container;

upper and lower generally horizontal reinforcement ribs integrally formed with and crossing the corner of the sidewall, wherein the upper reinforcement rib is below the upper edge of the sidewall, wherein the distance between the upper reinforcement rib and the upper edge of the sidewall is substantially the same around the periphery of the container, wherein the distance between the lower reinforcement rib and the upper edge of the sidewall is substantially the same around the periphery of the container, and wherein the distance between the lower reinforcement rib and the base is greater than the distance between the lower reinforcement rib and the upper edge of the sidewall; and a protruding handle connected to and integrally formed with the lower reinforcement rib, the protruding handle being between the upper and lower reinforcement ribs, wherein the base, the sidewall, the first corrugation, the upper and lower reinforcement ribs and the protruding handle are integrally formed together as a single unit via an injection molding.

* * * * *